US010188146B2

(12) United States Patent
Chen

(10) Patent No.: US 10,188,146 B2
(45) Date of Patent: Jan. 29, 2019

(54) ELECTRONIC CIGARETTE AND ATOMIZER DEVICE AND ATOMIZER ASSEMBLY THEREOF

(71) Applicant: Shenzhen Smoore Technology Limited, Shenzhen, Guangdong (CN)

(72) Inventor: Zhiping Chen, Guangdong (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 130 days.

(21) Appl. No.: 15/314,514

(22) PCT Filed: Jun. 28, 2016

(86) PCT No.: PCT/CN2016/087418
§ 371 (c)(1),
(2) Date: Nov. 29, 2016

(87) PCT Pub. No.: WO2018/000182
PCT Pub. Date: Jan. 4, 2018

(65) Prior Publication Data

US 2018/0049470 A1 Feb. 22, 2018

(51) Int. Cl.
*A24F 47/00* (2006.01)
*H05B 3/46* (2006.01)

(52) U.S. Cl.
CPC ..... *A24F 47/008* (2013.01); *A24F 47/00* (2013.01); *H05B 3/46* (2013.01)

(58) Field of Classification Search
CPC .. A24F 47/008; A61M 11/042; A61M 11/044; A61M 15/06
See application file for complete search history.

(56) References Cited

U.S. PATENT DOCUMENTS

| | | | | |
|---|---|---|---|---|
| 2014/0109921 | A1* | 4/2014 | Chen | A24F 47/008 131/273 |
| 2015/0059787 | A1* | 3/2015 | Qiu | A24F 47/008 131/329 |
| 2016/0000147 | A1* | 1/2016 | Li | A24F 47/008 131/329 |
| 2016/0100633 | A1* | 4/2016 | Gao | A24F 47/008 131/329 |
| 2017/0105453 | A1* | 4/2017 | Li | A24F 47/008 |
| 2017/0347705 | A1* | 12/2017 | Li | A24F 47/008 |
| 2017/0359858 | A1* | 12/2017 | Liu | H05B 1/0291 |
| 2018/0014577 | A1* | 1/2018 | Qiu | A24F 47/008 |
| 2018/0064172 | A1* | 3/2018 | Qiu | A24F 47/008 |

* cited by examiner

*Primary Examiner* — Tulsidas C Patel
*Assistant Examiner* — Marcus Harcum

(57) ABSTRACT

The present disclosure relates to an electronic cigarette and an atomizer device and an atomizer assembly thereof. The atomizer assembly includes a connection tube and an inner core assembly arranged in the connection tube. The connection tube defines a liquid inlet hole allowing liquid solution to flow into the connection tube, and the inner core assembly comprises a heater for heating and atomizing the liquid solution flowed into the connection tube. The connection tube includes a first connection member and a second connection member detachably connected to the first connection member; and the first connection member and the second connection member defines a receiving space in which the inner core assembly is detachably arranged.

21 Claims, 9 Drawing Sheets

ELECTRONIC CIGARETTE AND ATOMIZER DEVICE AND ATOMIZER ASSEMBLY THEREOF

BACKGROUND

1. Technical Field

The present disclosure generally relates to substitutes for cigarettes, and more particularly, to an electronic cigarette and an atomizer device and an atomizer assembly thereof.

2. Description of Related Art

An electronic cigarette is also known as a virtual cigarette or an electronic atomizer. The electronic cigarette is used as a substitute for cigarettes. The electronic cigarette has a similar exterior and smell to the cigarette, but generally without the harmful ingredients of cigarette such as tar and suspended particles.

The electronic cigarette generally includes a liquid reservoir assembly, an atomizer assembly, and a holder assembly arranged on one end of the liquid reservoir assembly. Since the atomizer assembly needs to be replaced after being in use for a period, the atomizer assembly is generally detachably connected to the liquid reservoir assembly.

A typical replaceable atomizer assembly includes a fixing tube configured for receiving and fixing an inner heating assembly and a connection tube located outside the fixing tube, and the fixing tube is generally fixed inside the connection tube through rivet connection. Structures such as screw threads are formed on the outer side of the connection tube for being fixed to the liquid reservoir assembly. Since the connection tube is visible to the consumer, therefore, the connection tube is even provided with external design for becoming more aesthetic. Moreover, since the connection tube needs to be provided with fixing structures such as screw threads for being fixed to the liquid reservoir assembly, the connection tube is relatively expensive for various reasons. However, when the atomizer assembly is replaced, the whole atomizer assembly is discarded, which results in the high cost of using the electronic cigarette.

SUMMARY

The technical problem of the present invention is to provide an improved electronic cigarette and an atomizer device and an atomizer assembly thereof.

To overcome the above-mentioned advantage, the present disclosure provides an atomizer assembly, including a connection tube and an inner core assembly arranged in the connection tube. The connection tube defines a liquid inlet hole allowing liquid solution to flow into the connection tube; the inner core assembly includes a heater for heating and atomizing the liquid solution flowing into the connection tube; the connection tube includes a first connection member and a second connection member detachably connected with the first connection member; and the first connection member and the second connection member defines a receiving space in which the inner core assembly is detachably arranged.

Preferably, the first connection member includes a first sleeve tube, the second connection member includes a second sleeve tube, and one end of the first sleeve tube is connected to one end of the second sleeve tube; and the inner core assembly is cylindrical and axially passes through the first sleeve tube and the second sleeve tube.

Preferably, the first connection member includes an annular first blocking wall abutting one end of the inner core assembly; the second connection member includes an annular second blocking wall abutting the other end of the inner core assembly; the two ends of the inner core assembly are respectively in sealing engagement with the first blocking wall and the second blocking wall; a central portion of the inner core assembly defines an axial through hole, and the through hole communicates with a center of the first blocking wall and a center of the second blocking wall to allow smoke to flow therethrough.

Preferably, the inner core assembly further includes a conducible fixing tube axially passing through the connection tube and a cylindrical liquid absorbing member arranged in the fixing tube for absorbing tobacco oil; the heater is arranged in the liquid absorbing member and is electrically connected to the fixing tube, and the fixing tube defines a liquid absorbing hole corresponding to the liquid inlet hole.

Preferably, a size of an inner hole of the first sleeve tube is different from that of an inner hole of the second sleeve tube to form a step at a connecting position of the first sleeve tube and the second sleeve tube on an inner wall of the connection tube after the first sleeve tube and the second sleeve tube are assembled together, and a positioning stage abutting the step is arranged on an outer wall of the fixing tube.

Preferably, an elastic annular first sealing gasket is arranged between the first connection member and the corresponding end of the inner core assembly, an elastic annular second sealing gasket is arranged between the second connection member of the corresponding end of the inner core assembly; the first sealing gasket and the second sealing gasket are respectively interchangeable between a compressed state and a rebounding state; after the first connection member and the second connection member are installed, the first sealing gasket and the second sealing gasket are compressed; after the first connection member and the second connection member are detached, the first sealing gasket and the second sealing gasket respectively rebound from the compressed state.

Preferably, the atomizer assembly further includes a conducible first electrode; the first electrode includes a cylindrical body, and the cylindrical body passes through in an inner hole of the first blocking wall and is insulated from the first blocking wall; the first electrode is electrically connected to the heater; and the connection tube is made of conducible material and is electrically connected to the fixing tube.

Preferably, the inner core assembly further includes a conducible cylindrical second electrode; the second electrode passes through an end side hole of the fixing tube corresponding to the first blocking wall, and an insulation cover is arranged between the first second electrode and the end side hole of the fixing tube; and an outer ring of the second electrode is electrically connected to the heater, the first electrode and the second electrode axially abut each other and are in conduction with each other, and the first electrode is electrically connected to the heater through the second electrode.

The present disclosure also provides an atomizer device including the above atomizer assembly.

Preferably, the atomizer device further includes a conducible atomizer base, and the connection tube is detachably connected with the atomizer base.

Preferably, the atomizer device further includes a liquid reservoir assembly; the atomizer assembly is detachably connected with the liquid reservoir assembly, and the liquid reservoir assembly forms a liquid reservoir chamber for containing liquid solution, a liquid outlet allowing the liquid solution to flow out of the liquid reservoir chamber, and a blocker blocking in the liquid outlet;

the atomizer assembly is screwed to the liquid reservoir assembly and is capable of driving the blocker to rotate, thereby driving the blocker to rotate to open the liquid outlet while being installed and driving the blocker to rotate to close the liquid outlet while being removed; and the liquid outlet corresponds to the liquid inlet hole such that liquid solution can be injected into the connection tube when the liquid outlet is opened.

Preferably, the blocker is annular-tubular-shaped and is axially positioned and installed; and the blocker is formed with screw threads allowing for screw installation of the atomizer assembly.

Preferably, an inclined surface is defined at an edge of a bottom end surface of the blocker, and the inclined surface is formed with knurling or grooves which are circumferentially spaced.

Preferably, the atomizer base includes a threaded portion engaging with screw threads formed on the blocking portion, an outer ring of the threaded portion is provided with a sealing ring, and a position of the sealing ring corresponds to that of the inclined surface.

Preferably, an opening corresponding to the liquid outlet is defined in the blocker; before the atomizer assembly is installed, the opening misaligns with the liquid outlet to close the liquid outlet; and after the atomizer assembly is installed, the opening aligns with the liquid outlet to communicate the liquid reservoir chamber with the atomizer assembly.

Preferably, the number of the liquid outlet and that of the opening are respectively four, and the four liquid outlets and the four openings are respectively circumferentially evenly spaced; and a size of the liquid outlet corresponds to that of the opening, and a maximum radian of the liquid outlet or a maximum radian of the opening is less than 45 degrees.

Preferably, the liquid reservoir assembly includes an inner tube and an outer tube; the liquid reservoir chamber is formed between the inner tube and the outer tube; and the liquid outlet is formed in the inner tube, and the blocker is attached to an inner wall of the inner tube.

Preferably, a lower end of the inner tube is formed with a bending portion extending laterally outwards and a sleeved portion extending axially downwards from on an outer edge of the bending portion; the blocker includes a sleeve tube sleeved by an inner wall of the inner tube and an annular-tube-shaped blocking portion arranged on a lower end of the sleeve tube; the blocking portion and the sleeve tube are coaxially arranged, and an outer radius of the blocking portion is greater than that of the sleeve tube; and an upper end of the blocking portion abuts the bending portion, and the sleeved portion is sleeved on the blocking portion.

Preferably, the liquid reservoir assembly further includes a positioning ring; the positioning ring includes a third sleeve tube located between the sleeved portion and the blocking portion; the sleeved portion, the third tube, and the blocking portion are sleevedly connected in sequence from outside to inside; and an inner ring of the third sleeve tube is formed with a protrusion abutting a lower end of the blocking portion.

Preferably, the atomizer device further includes a restricting mechanism for restricting a rotation range of the blocker.

Preferably, the restricting mechanism includes an arc slot formed in the inner tube and a convex stage arranged on the blocker being inserted into the arc slot.

Preferably, the arc slot is formed in the bending portion, and the convex stage is arranged on an end surface of the blocking portion corresponding to the bending portion.

Preferably, a first friction is generated between the blocker and the liquid reservoir assembly, a second friction is generated between the blocker and the atomizer assembly, and the second friction is greater than the first friction.

The present disclosure further provides an electronic cigarette including the above atomizer device.

The electronic cigarette described above has beneficial effects as below: through the detachable first connection member and the second connection member of the electronic cigarette and the atomizer device and the atomizer assembly of the electronic cigarette, the replacement of the atomizer assembly can be satisfied by replacing the inner core assembly while retaining the higher-cost connection tube, which reduces the cost of the replacement of the atomizer assembly.

BRIEF DESCRIPTION OF THE DRAWINGS

The present disclosure will be described in more detail with reference to the accompany drawings and the embodiments, wherein in the drawings:

FIG. 4 is a cross-sectional view of the liquid reservoir assembly and an atomizer base in a disassembled state shown in FIG. 2;

DETAILED DESCRIPTION

For clearly understanding technical features, purpose, and effect of the present disclosure, embodiments are given in detail hereinafter with reference to the accompanying drawings.

Figure 1:
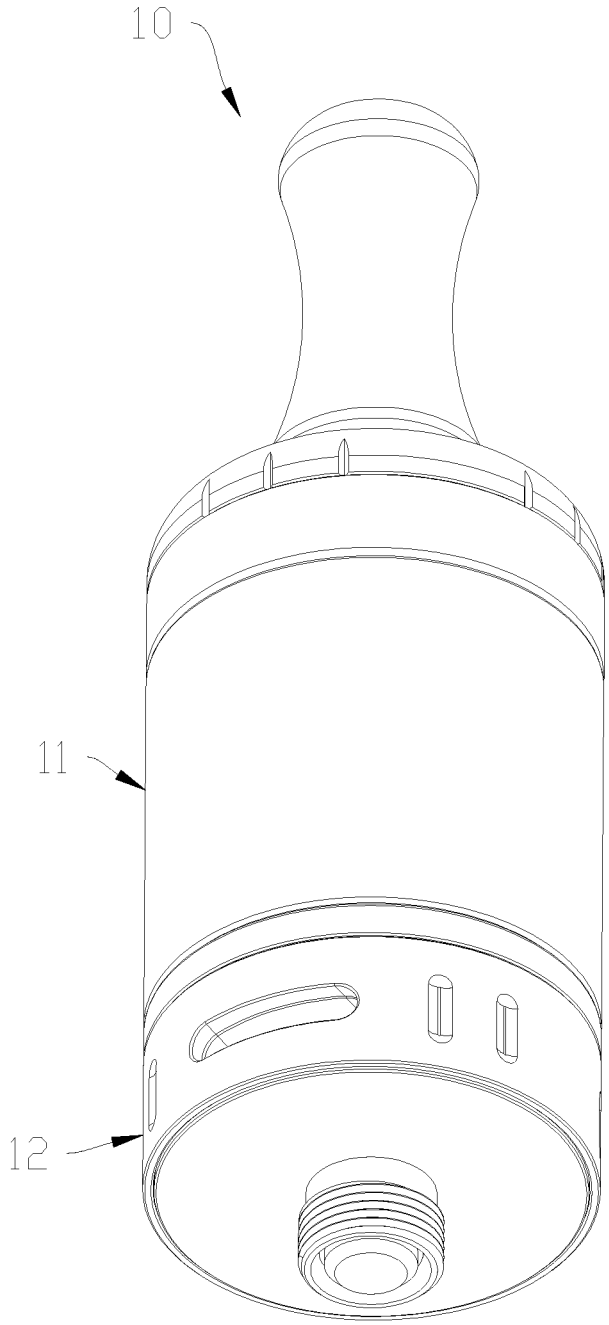
FIG. 1 is a perspective view of an atomizer device of an electronic cigarette in according with an embodiment of the present disclosure.
Figure 2:
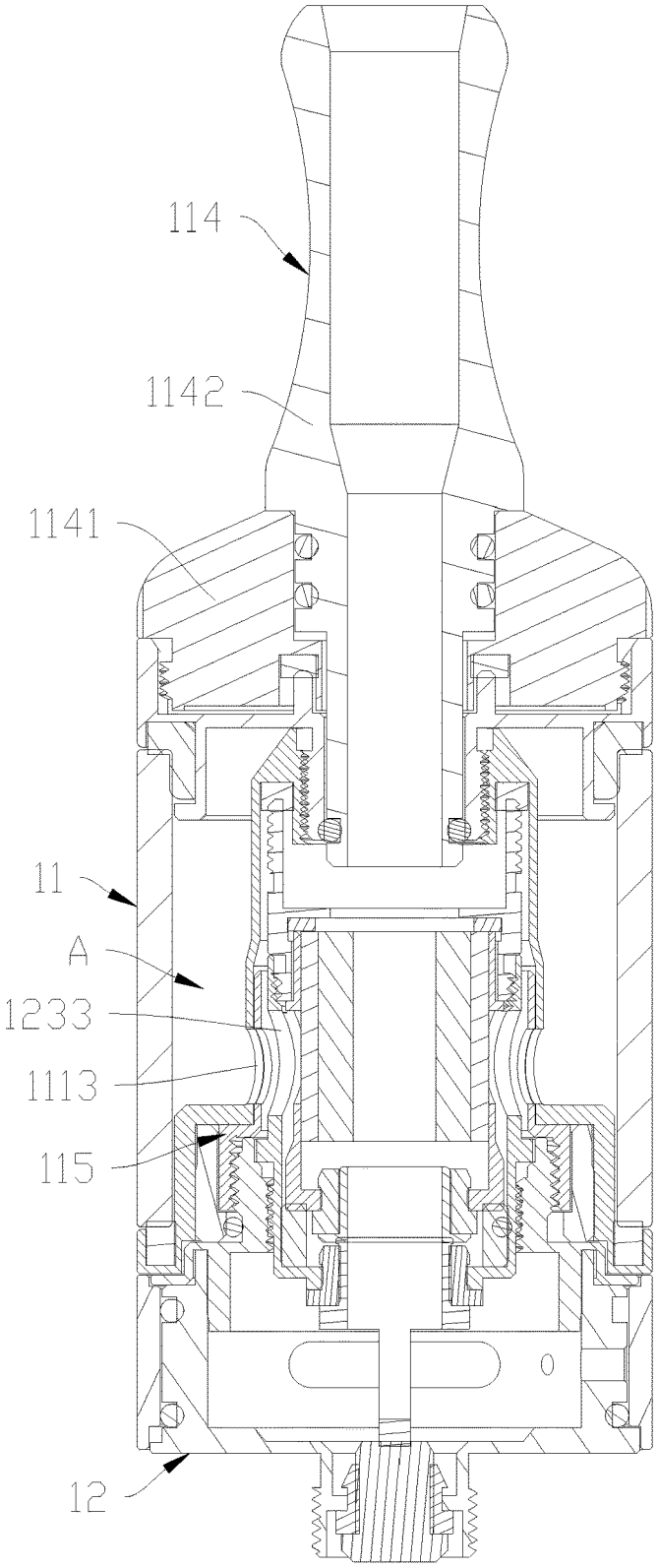
FIG. 2 is a cross-sectional view of the atomizer device shown in FIG. 1.
Figure 3:
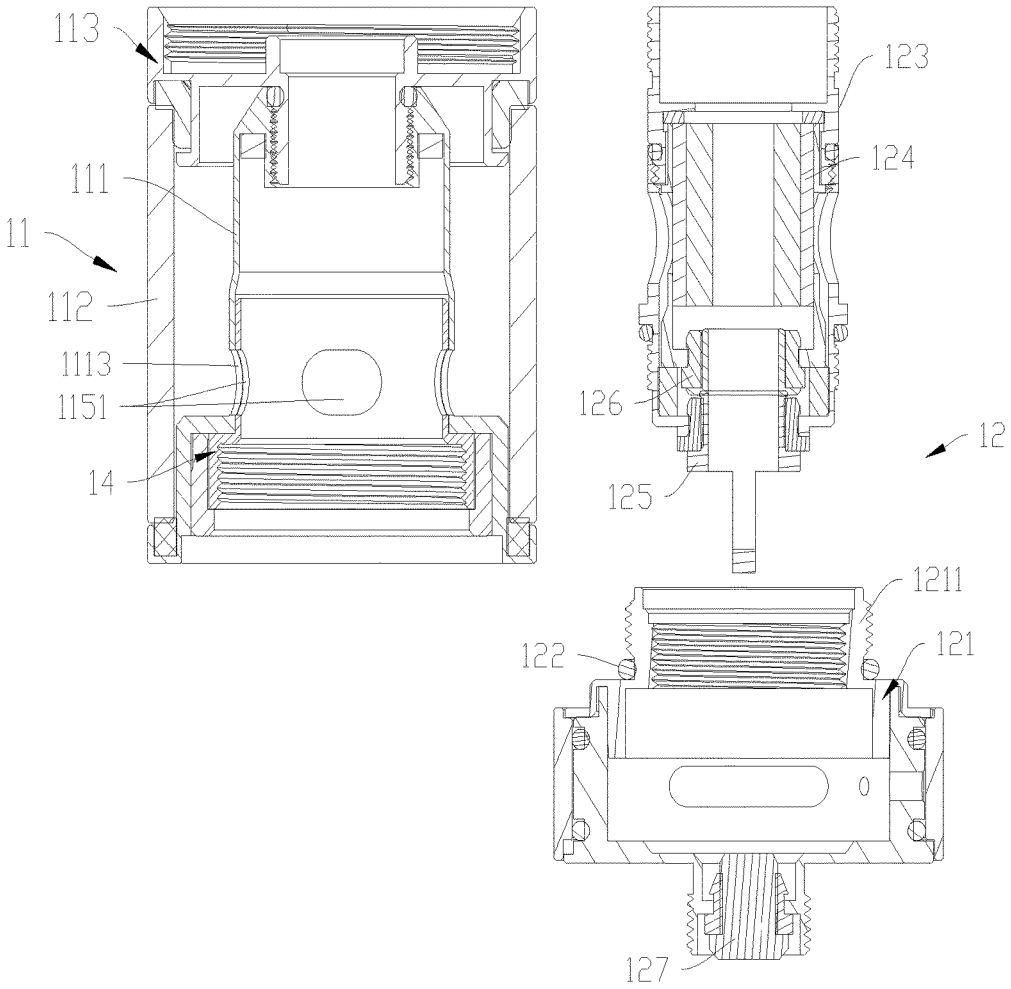
FIG. 3 is an disassembled cross-sectional view of a liquid reservoir assembly and an atomizer assembly shown in FIG. 2.

Referring to FIG. 1, an electronic cigarette in accordance with an embodiment of the present disclosure includes an atomizer device 10 and a power supply (not shown). After the atomizer device 10 and the power supply are installed together, the power supply supplies power for the atomizer device 10 to atomize the liquid solution, allowing a user to smoke.

Referring to FIGS. 2 to 4*b*, the atomizer device 10 includes a liquid reservoir assembly 11 and an atomizer assembly 12 detachably connected to the liquid reservoir assembly 11. The atomizer assembly 12 is screwed to the liquid reservoir assembly 11. The liquid reservoir assembly 11 includes a liquid reservoir chamber A for containing liquid solution, a liquid outlet 1113 allowing the liquid solution to flow out of the liquid reservoir chamber A, and a blocker 115 blocking in the liquid outlet 1113.

The atomizer assembly 12 is screwed to the liquid reservoir assembly 11 and is capable of driving the blocker 115 to rotate. During the installation and removal of the atomizer assembly 12, the atomizer assembly 12 drives the blocker 115 to rotate to respectively open and close the liquid outlet 1113. The atomizer assembly 12 is formed with a liquid inlet 1233 allowing liquid solution to flow into the atomizer assembly 12. The liquid inlet 1233 corresponds to the liquid outlet 1113 such that liquid solution can be injected to the atomizer assembly 12 when the liquid outlet 1113 is opened. With the above structure, when the atomizer assembly 12 is removed and replaced, the rotation of the atomizer assembly 12 can drive the blocker 115 to rotate to close the liquid outlet 1113, which avoids the leakage of liquid solution and thus avoids the waste of liquid solution and the pollution to other components caused by the leakage of liquid solution.

The liquid reservoir assembly 11 includes an inner tube 111, an outer tube 112, an end cover 113, and a holder assembly 114. A lower end of the inner tube 111 is formed with a bending portion 111 extending laterally outwards and a sleeved portion 1112 extending axially downwards from an outer edge of the bending portion 111. The outer tube 112 is sleeved on the inner tube 111, and a lower end of the outer tube 112 and an outer wall of the sleeved portion 1112 are sealed to each other. The liquid reservoir chamber A is formed between the inner tube 111 and the outer tube 112, and the liquid outlet 1113 is formed in the inner tube 111.

Upper ends of the inner tube 111 and the outer tube 112 define an annular opening, and the end cover 113 is arranged on the annular opening to cover the annular opening. Generally, a liquid injecting opening is defined in the end cover 113 through which liquid solution is injected to the liquid reservoir chamber A. A through hole communicating with the inner tube 111 is defined in the middle portion of the end cover 113 allowing for flowing of smoke.

The holder assembly 114 includes an annular top cover 1141 and a hollow holder 1142. The top cover 1141 is mounted on the end cover 113 to cover and seal the liquid injecting opening defined in the end cover 113. The holder 1142 passes through the top cover 1141 and is inserted into the inner tube 111, allowing air to flow out of the holder 1142.

In the embodiment, the blocker 115 is annular-tube-shaped. The blocker 115 is rotatably arranged and is axially installed and positioned. The blocker 115 is attached to an inner wall of the inner tube 111. An opening 1151 corresponding to the liquid outlet 1113 is defined in the blocker 115. When the atomizer assembly 12 is rotated, the blocker 115 is driven to rotate such that the opening 1151 in the blocker 115 aligns with or misaligns with the liquid outlet 1151, thereby opening or closing the liquid outlet 1113.

Before the atomizer assembly 12 is installed, the opening 1151 misaligns with the liquid outlet 1113 to close the liquid outlet 1113. After the atomizer assembly 12 is installed, the opening 115 aligns with the liquid outlet 1113 to communicate the liquid reservoir chamber A with the atomizer assembly 12. In other embodiments, the blocker 115 can has a rotatable plate structure with a curved surface which closes and opens the liquid outlet 1113 during rotation.

In an embodiment, the blocker 115 is formed with screw threads allowing for screw installation of the atomizer assembly 12. The atomizer assembly 12 is in screw engagement with the blocker 115.

Figure 4A:
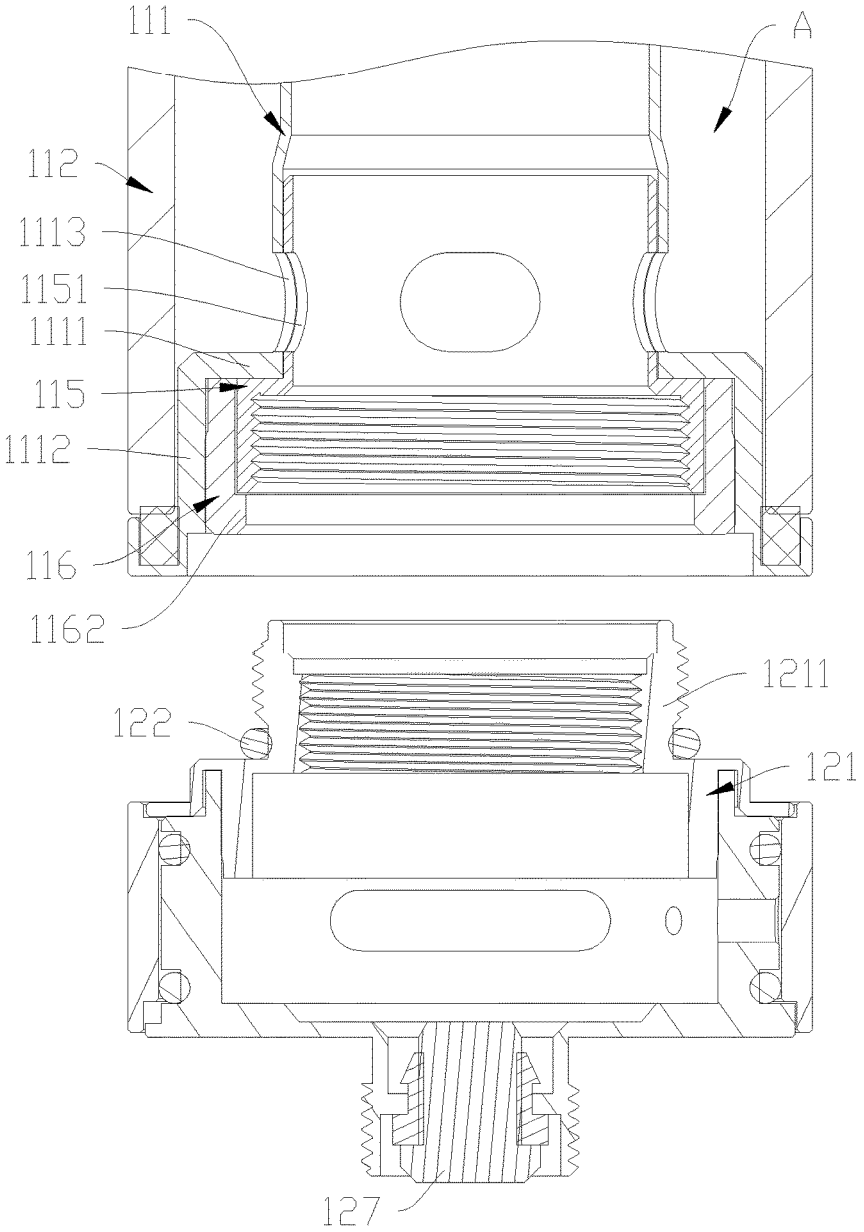
FIG. 4*a* is a disassembled view showing that a rotation of the atomizer assembly of FIG. 3 drives a blocker to rotate to open a liquid outlet.
Figure 4B:
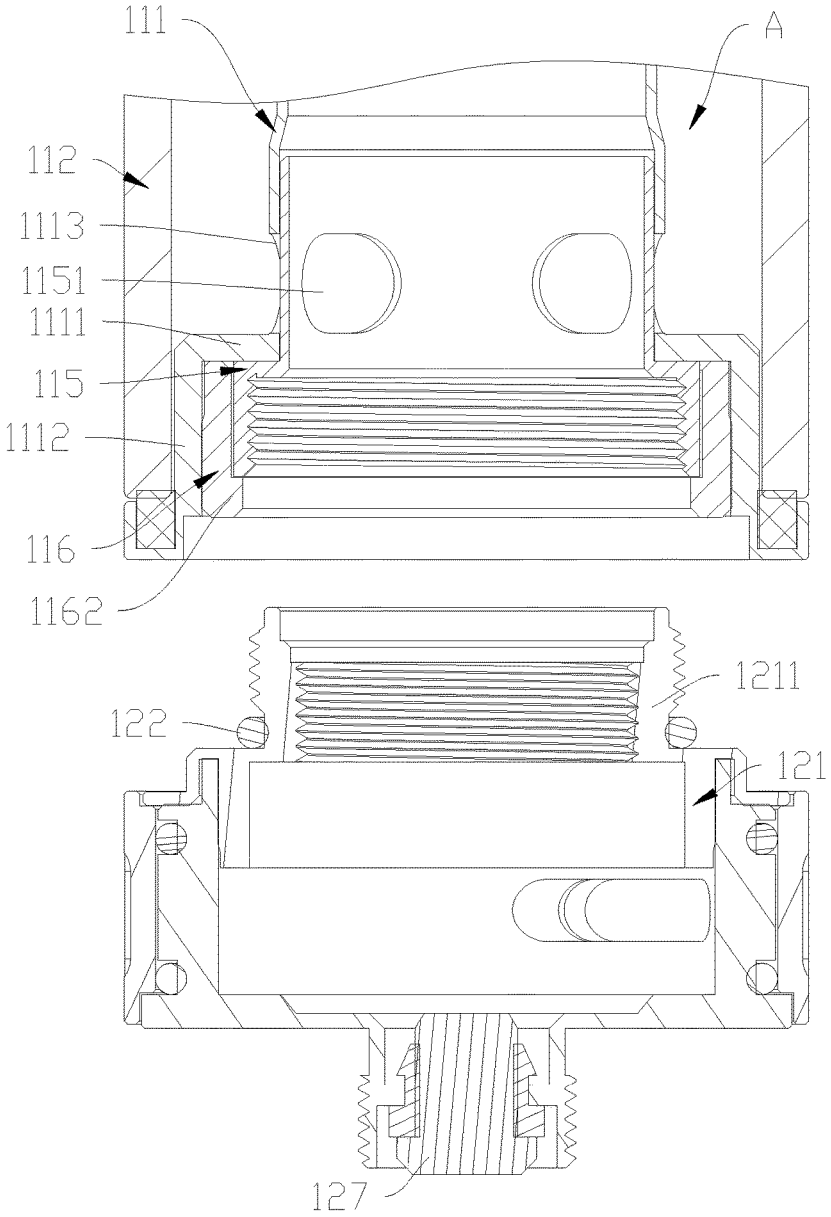
FIG. 4*b* is a disassembled view showing that the rotation of the atomizer assembly drives the blocker to rotate to close the liquid outlet.
Figure 5:
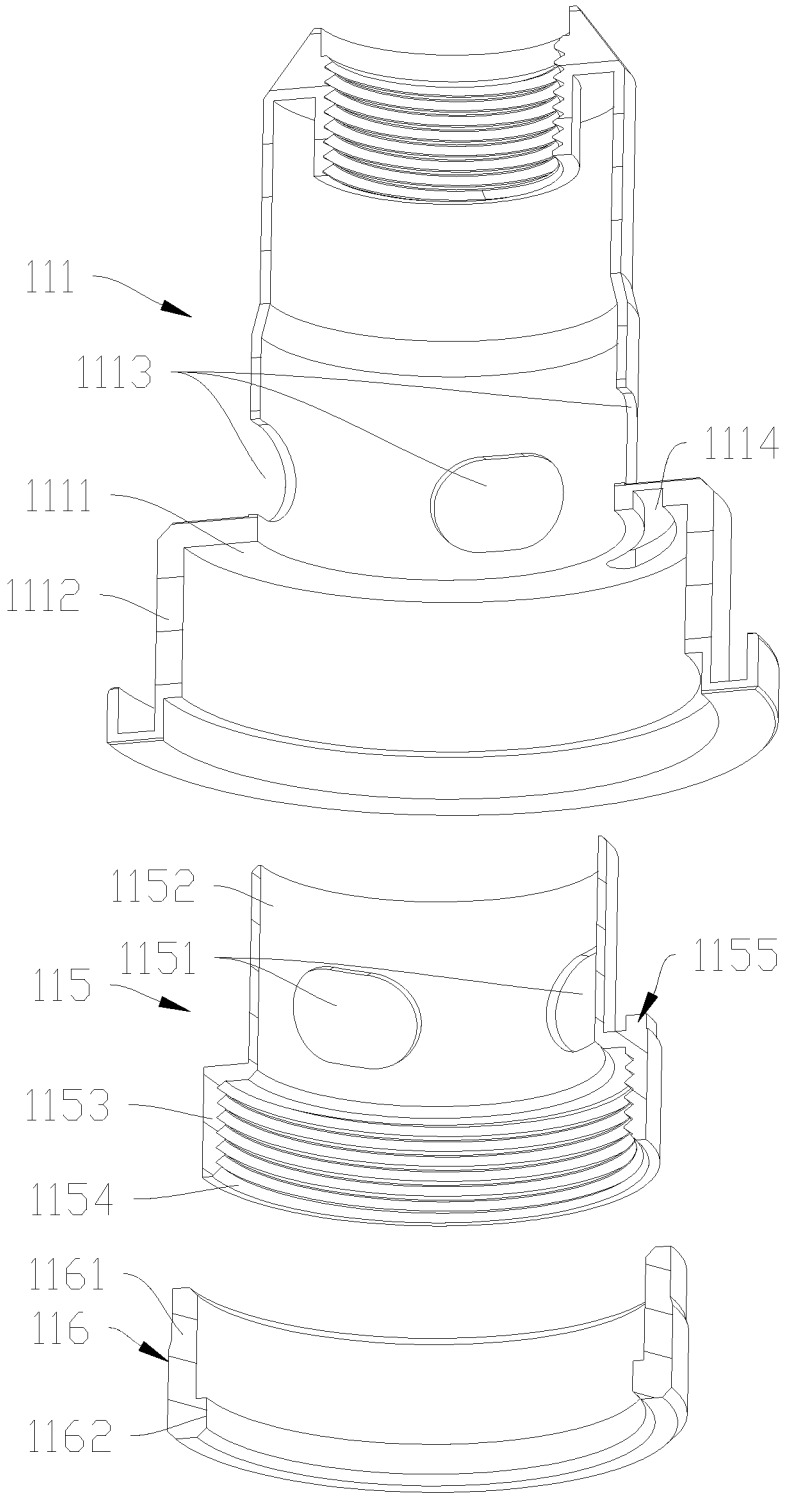
FIG. 5 is a cross-sectional view of an inner tube, the blocker, and a positioning ring shown in FIG. 4*a* in a disassembled state.

Referring to FIGS. 4*a*, 4*b*, and 5, the blocker 115 includes a sleeved tube 1152 sleeved by the inner wall of the inner tube 111 and an annular blocking portion 1153 arranged on a lower end of the sleeved tube 1152. The opening 1151 corresponding to the liquid outlet 1113 is defined in the sleeved tube 1152. The blocking portion 1153 is coaxial with the sleeved tube 1152, and an outer radius of the blocking portion 1153 is greater than of that of the sleeved tube 1152. An upper end of the blocking portion 1153 abuts the bending portion 1111 to axially position the blocker 115. The sleeved portion 1112 is sleeved on the blocking portion 1153 to allow for the rotatable arrangement of the blocker 115, in other embodiments, the liquid outlet 1113 can be formed in the bending portion 1111, and the opening 1151 can be accordingly defined in an end wall of the blocking portion 1153 corresponding to the liquid outlet 1113.

Furthermore, in order to position the blocker 115, the liquid reservoir assembly 11 further includes a positioning ring 116. The positioning ring 116 includes a third sleeve tube 1161 located between the sleeved portion 1112 and the blocking portion 1153. The sleeved portion 1112, the third sleeve tube 1161, and the blocking portion 1153 are sleevedly connected in sequence from outside to inside. A protrusion 1162 abutting a lower end of the blocking portion 1153 is formed on an inner ring of the third sleeve tube 1161. Generally, the third sleeve tube 1161 is riveted to the sleeved portion 1112 to fix the position of the third sleeve tube 1161; the protrusion 1162 is capable of abutting a lower end of the blocker 115 to avoid lateral movement and dropping of the blocker 115.

Optionally, an inner wall of the blocking portion 1153 is formed with screw threads allowing for the installation of the atomizer 12. In other embodiments, the screw threads can be formed on an inner wall of the sleeved tube 1152. The protrusion 1162 abuts an outer edge of the corresponding end surface of the blocking portion 11153; and an inclined surface 1154 is defined on an edge of an end surface of the blocking portion 1153 corresponding to the protrusion 1162, for guiding the protrusion 1162 to the inner wall of the blocking portion 1153.

In some embodiments, the inclined surface 1154 is provided with knurling or several circumferentially-spaced groves, which increases the friction between the atomizer assembly 12 and the blocker 115 after the atomizer assembly 12 is tightly rotated to the blocker 115.

A first friction is generated between the blocker 115 and the inner tube 111 of the liquid reservoir assembly 11, thus, during the installation of the atomizer assembly 12, the atomizer assembly 12 is at first screwed to the blocker 115 and then the atomizer assembly 12 drives the blocker 115 to overcome the first friction to rotate together to open the liquid outlet 1113. This ensures that the liquid outlet 1113 is opened after the atomizer assembly 12 is installed, prevents the liquid outlet 1113 from being opened before the installation of the atomizer assembly 12 is completed, and thus avoids the leakage of liquid solution. In other embodiments, the first friction can be generated between the blocker 115 and other components of the liquid reservoir assembly 11. When the atomizer assembly 12 and the blocker 115 are fixed together, a second friction is generated between the blocker 115 and the atomizer assembly 12. The second friction is greater than the first friction, thus, when the atomizer assembly 12 is detached from the blocker 115, the atomizer assembly 12 drives the blocker 115 to mover together to close the liquid outlet 1113 before being separated from the blocker 115. In this way, the liquid outlet 113 is closed at first when the atomizer assembly 12 is detached to avoid leakage of liquid solution.

Referring to FIGS. 4*a*, 4*b*, and 5, the atomizer assembly 12 includes an atomizer base 121 having a threaded portion 1211 engaging with the screw threads formed on the blocking portion 1153. A sealing ring 122 is sleeved on an outer ring of the threaded portion 1211, and a position of the sealing ring 122 corresponds to that of the inclined surface 1154. After the atomizer assembly 12 is tightly rotated to the blocker 115, the sealing ring 122 is in tight contact with the inclined surface 1154. The engagement between the sealing ring 122 and the grooves formed in the inclined surface 1154 can greatly increase the friction between the sealing ring 122 and the inclined surface 1154. By adjusting the friction generated between the blocker 115 and other installed components, during the installation of the atomizer assembly 12, the blocker 115 can be driven to rotate to open the liquid outlet 1113 when the threaded portion 1211 completely engage with the screw threads formed on the blocker 115. During the detachment of the atomizer assembly 12, by the friction between the sealing ring 122 and the grooves of the blocker 115, the blocker 115 is driven to rotate to close the liquid outlet 1113, the atomizer base 121 is driven to rotate relative to the blocker 115 to separate the screw connection between the threaded portion 1211 and the screw threads of the blocker 115, such that the atomizer assembly can be axially released. In other embodiments, the blocker 115 can be clamped to the atomizer base 121.

Referring to FIG. 5, in order to ensure that the rotation of the blocker 115 is capable of exactly opening or closing the liquid outlet 1113 and prevent the improper rotation angle of the blocker 115 from re-opening or re-closing the liquid outlet 1113, a restricting mechanism is arranged on the atomizer device 10 for restricting the rotation range of the blocker 115.

Optionally, the restricting mechanism includes an arc slot 1114 formed in the inner tube 111 and a convex stage 1155 arranged on the blocker 115 being inserted into the arc slot 1114. Furthermore, the arc slot 1114 is formed in the bending portion 1111, and the convex stage 1155 is arranged on an end surface of the blocking portion 1153 corresponding to the bending portion 1111. The arc slot 1114 can be formed in a side of the bending portion 11111 facing the blocking portion 1153. In some embodiments, the arc slot can be a through slot.

Furthermore, the number of the liquid outlet 1113 and the opening 1151 are respectively four, and the four liquid outlets 1113 and the four openings 1151 are respectively evenly-spaced in circumferential direction. The size of each liquid outlet 1113 corresponds to that of each opening 1151. The configuration that the four or more liquid outlets 1113 and the openings 1151 are arranged in the circumferential direction allows the liquid solution to be absorbed more uniformly. Optionally, when the number of the liquid outlet 1113 and the opening 1151 are respectively four, and the maximum radian of the liquid outlet 1113 and the opening 1151 in circumferential direction are respectively 45 degrees, the maximum rotation degree of the convex stage 1155 in the arc slot 1114 is 45 degrees. At this time, after the blocker 115 is rotated over 45 degrees, the opening 1151 exactly aligns with the liquid outlet 1113 to open the liquid outlet 1113; after the blocker 115 is rotated over another degrees, the opening 1151 exactly misaligns with the liquid outlet 1113 to close the liquid outlet 1113. In other embodiments, when the number of the liquid outlets 1113 and the openings 1151 arranged in the circumferential direction are respectively four, the rotation angle of the convex stage 1155 in the arc slot 1114 also can be less than 45 degrees. In some embodiments, the rotation angle of the convex stage 1155 in the arc slot 1114 can accordingly change when the number and arrangement way of the liquid outlets 1113 and the openings 1151 in the circumferential direction change.

Referring to FIGS. 3 and 6-8, the atomizer assembly 12 further includes a connection tube 123 mounted on the atomizer base 121, an inner core assembly 124 arranged inside the connection tube 123, a conducible first electrode 125 arranged on the connection tube 123, and a pin 127 arranged on the atomizer base 121.

Figure 6:
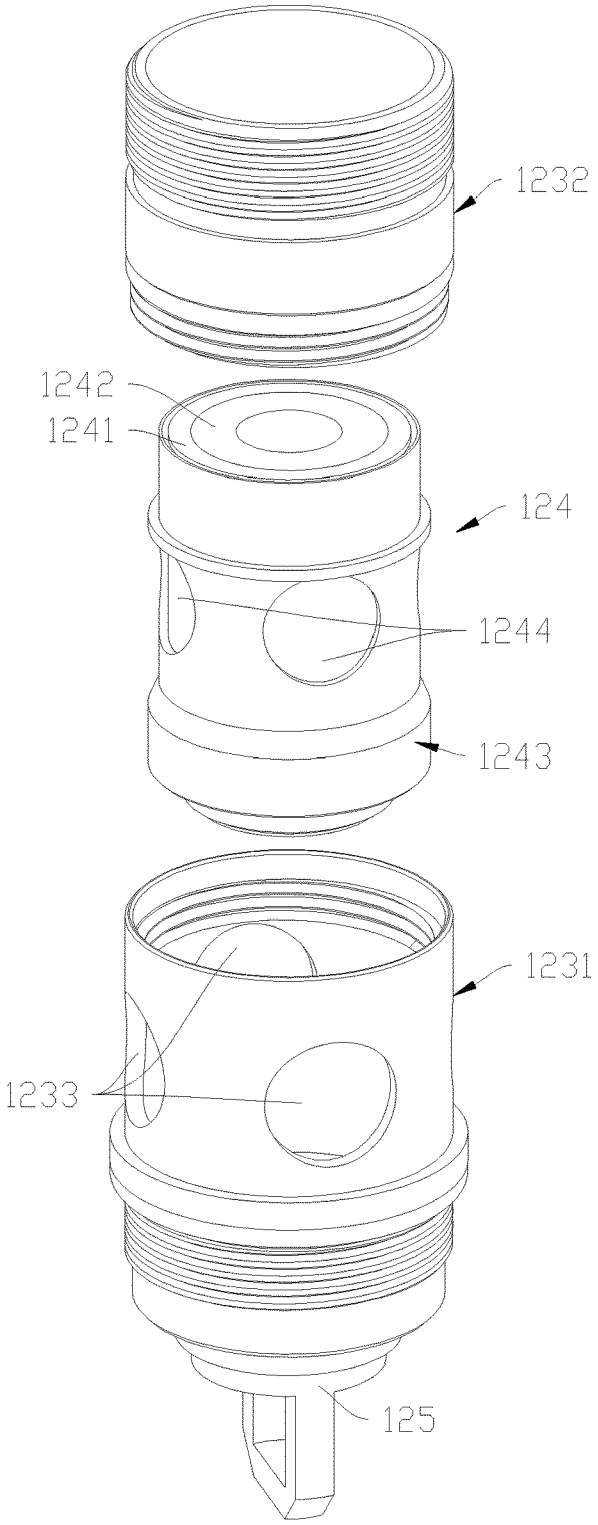
Figure 7:
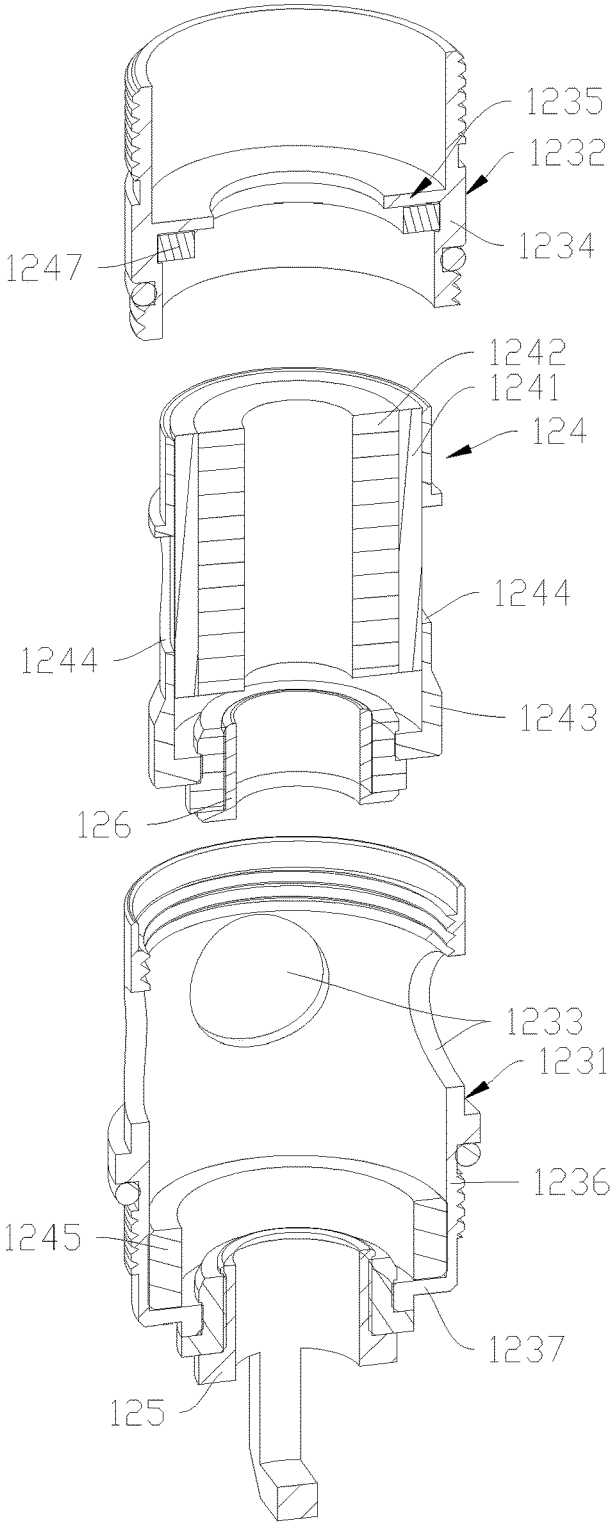
FIG. 7 is a cross-sectional view of the connection tube and the inner core assembly of the atomizer assembly shown in FIG. 6.
Figure 8:
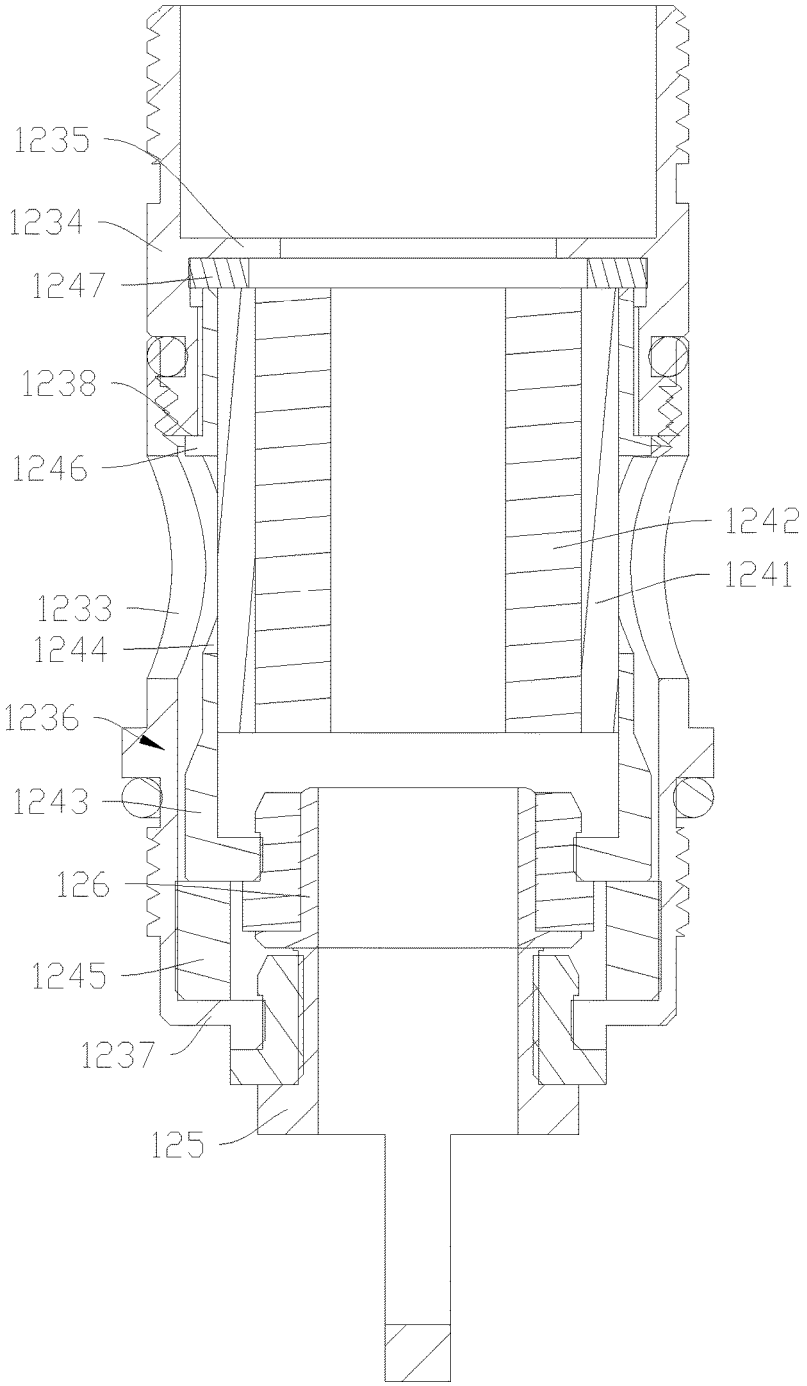
FIG. 8 is a cross-sectional view of the connection tube and the inner core assembly in an assembled state in accordance with disclosed embodiments.

Referring to FIGS. 6 to 8, the connection tube 123 includes a first connection member 1231, and a second connection member 1232 detachably connected with the first connection member 1231. The first connection member 1231 and the second connection member 2232 define a receiving space in which the inner core assembly 124 is detachably arranged. The inner core assembly 124 is replaceable. The inner core assembly 124 is fixed in the connection tube 123 after the first connection member 1231 and the second connection member 1232 are installed. A liquid inlet hole 1233 allowing liquid solution to flow into the connection tube 123 is defined in the connection tube 123. The liquid inlet hole 1233 corresponds to the liquid outlet 1113 formed in the inner tube 111, such that liquid solution can flow into the connection tube 123 through the liquid inlet 1233 when the liquid outlet 1113 is opened. Through the detachable first connection member 1231 and second connection member 1232, the replacement of the atomizer assembly 12 can be satisfied by replacing the inner core assembly 124 while retaining the higher-cost connection tube 123. Thus, the cost of the replacement of the atomizer assembly 12 is correspondingly reduced.

The first connection member 1231 includes a first sleeve tube 1236 and an annular first blocking wall 1237. The first sleeve tube 1236 is arranged on an outer ring of the first blocking wall 1237. The second connection member 1232 includes a second sleeve tube 1234 and an annular second blocking wall 1235. The second sleeve tube 1234 is arranged on an outer ring of the second blocking wall 1235. One end of the first sleeve tube 1236 is screwed to one end of the second sleeve tube 1234. The inner core assembly 124 is columnar-shaped and axially passes through the first connection tube 1236 and the second connection tube 1234. A central hole of the first blocking wall 1237 and a central hole of the second blocking wall 1235 respectively communicate with outside environment; one of the two central holes forms an air intake communicating with the air inlet in the atomizer base 121; the other one of the two central holes forms an air outtake communicating with the inner tube 111 and the holder 1142. Optionally, an axial through hole is defined in the central portion of the inner core assembly 124; and the through hole respectively communicates with the centers of the first blocking wall 1237 and the second blocking wall 1235 to allow for flowing of smoke. The structures of the first connection member 1231 and the second connection member 1232 are not limited to this embodiment; in other embodiments, the first connection member 1231 and the second connection member 1232 can respectively be shell-structured, and the first connection member 1231 and the second connection member 1232 can be connected through any proper type of structure capable of securing the atomizer assembly 12, for example, the first connection member 1231 can be clamped to the second connection member 1232.

After the first connection member 1231 and the second connection member 1232 are installed, the first blocking wall 1237 and the second blocking wall 1235 respectively abut two ends of the inner core assembly 124, and the two ends of the inner core assembly 124 are respectively sealed to the first connection member 1231 and the second connection member 1232, preventing liquid solution in the inner core assembly 124 from flowing to the centers of the first blocking wall 1237 and the second blocking wall 1235. The liquid inlet hole 1233 is defined in the first sleeve tube 1236; in other embodiments, the liquid inlet hole 1233 also can be defined in the second sleeve tube 1234 or defined after the first sleeve tube 1236 and the second sleeve tube 1234 are installed together.

The inner core assembly 124 includes a conducible fixing tube 1243 axially passing through the connection tube 123, a cylindrical liquid absorbing member 1241 arranged in the fixing tube 1243 for absorbing tobacco oil, a heater 1242, and a second electrode 126 arranged on one end of the fixing tube 1243 and electrically connected to the heater 1242. The second electrode 126 is insulated from the fixing tube 1243. The heater 1242 is arranged in the liquid absorbing member 1241 and is electrically connected to the fixing tube 1243. The heater 1242, the liquid absorbing member 1241, and the fixing tube 1243 are placed in the connection tube 123 after being installed together as a whole. The fixing tube 1243 defines a liquid absorbing hole 1233 corresponding to the liquid inlet hole 1233, such that liquid solution can flow to the liquid absorbing member 1241 through the liquid inlet hole 1233 and the liquid absorbing hole 1244. Optionally, the position and number of the liquid inlet hole 1233 defined in the connection tube 123 and the position and number of the liquid absorbing hole 1244 defined in the fixing tube 1243, are respectively identical to the position and the number of the liquid outlet 1113, which allows the liquid solution to smoothly flow into the atomizer assembly 12. In other embodiments, the position and number of the liquid inlet hole 1233 and the position and number of the liquid absorbing hole 1244 can be accordingly adjusted, for example, the liquid inlet hole 1233 can circumferentially or axially stagger from the corresponding liquid absorbing hole 1244.

In some embodiments, the fixing tube 1243 is made of metal and has a relatively-high rigidity. In order to realize the sealing state between the end surface of the atomizer assembly 12 and the first blocking wall 1237 and the second blocking wall 1235, an elastic annular first sealing gasket 1245 is arranged between the second blocking wall 1235 and the corresponding end portion of the fixing tube 1243, and an elastic annular second sealing gasket 1247 is arranged between the second blocking wall and the corresponding end portion of the fixing tube 1243. The first sealing gasket 1245 and the second sealing gasket 1247 are made of flexible material, being capable of interchanging between a compressed state and a rebounding state. After the first connection member 1231 and the second connection member 1232 are installed together, the first sealing gasket 1245 and the second sealing gasket 1247 are compressed, and the fixing tube 1243 of higher rigidity can ensure the sealingness after the fixing tube 1243 abuts the first blocking wall 1237 and the second blocking wall 1235. After the connection member 1231 and the second connection member 1232 are detached, the first sealing gasket 1245 rebounds from the compressed state to allow the atomizer assembly 12 to be removed, which facilitates the removal and replacement of the inner core assembly 124. In other embodiments, the first sealing gasket 1245 can be arranged between one end of the inner core assembly 124 and the first connection member 1231, and the second sealing gasket 1247 can be arranged between the other end of the inner core assembly and the second connection member 1232, such that the inner core assembly can be rebounded.

Optionally, a size of the inner hole of the first sleeve tube 1236 is different from that of the inner hole of the second sleeve tube 1234. After the first sleeve tube 1236 and the second sleeve tube 1234 are installed, a step 1238 is formed on an inner wall of the connection tube 123 at the connection position of the first sleeve tube 1236 and the second sleeve tube 1234. A positioning stage 1246 is arranged on an outer wall of the fixing tube 1243 for correspondingly abutting the step 1238. Generally, the first connection member 1231 is located at a lower position, and the second connection member 1232 is located at an upper position, the inner hole of the second sleeve tube 1234 is smaller than that of the first sleeve tube 1236, thus, after the first connection member 1231 and the second connection member 1232 are installed together, the positioning stage 1246 is formed on inner walls of the first sleeve tube 1236 and the second sleeve tube 1234. During the installation of the inner core assembly 124, after the inner core assembly 124 is mounted into the first sleeve tube 1236, the second sleeve tube 1234 is secured to the first sleeve tube 1236 by covering on the inner core assembly 124. One end surface of the second sleeve tube 1234 corresponding to the first sleeve tube 1236 abuts the positioning stage 1246 of the fixing tube 1243 to prevent the inner core assembly 124 from moving axially and abut the fixing tube to avoid the movement of the fixing tube 1243 during usage, thereby ensuring that the liquid absorbing hole 1244 corresponds to the liquid inlet hole 1233. In other embodiments, the step 1238 can be formed on the inner wall of the first sleeve tube 1236 or the second sleeve tube 1234 for axially positioning the fixing tube 1243.

The liquid absorbing member 1241 can be a tubular liquid absorbing sponge, a tubular porous ceramic body, or a combination of the tubular porous ceramic body and the liquid absorbing sponge enclosing the porous ceramic body. The heater 1242 can be a heating coil, a heating film, or other heating components arranged inside the liquid absorbing member 1241. After the liquid solution absorbed by the liquid absorbing member 1241 is vaporized, the smoke flows to one end of the holder 1142 with airflow.

The second electrode 126 is cylindrical and passes through an end side hole of the fixing tube 1243 corresponding to the first blocking wall 1237. The second electrode 126 is insulated from the end side hole of the fixing tube 1243. Generally, an insulation cover is arranged between an outer ring of the second electrode 126 and the end side hole of the fixing tube 1243.

The first electrode 125 includes a cylindrical body which passes through the inner hole of the first blocking wall 1237 and is insulated from the first blocking wall 1237. Generally, an insulation cover is arranged between the first electrode 125 and the first blocking wall 1237 to insulate the first electrode 125 from the first blocking wall 1237. The first electrode 125 and the second electrode 126 axially abut each other and are in conduction with each other. The first electrode 125 is electrically connected to the heater 1242 through the second electrode 126. The second electrode 126 arranged in the end side hole of the fixing tube 1243 is capable of contacting with the first electrode 125 through the resilience of the insulation cover when the fixing tube 1243 is pressed under an axial force after being mounted in the connection tube 123. Even when the axial force applying to the fixing tube 1243 is too large, the abutting force generated between the first electrode 125 and the second electrode 126 are maintained on a suitable level through the resilience of the insulation sleeve. Thus, the first electrode 125 can be kept in good contact with the second electrode 126; further, the abrasion between the first electrode 125 and the second electrode 126 can be reduced. In other embodiments, the second electrode 126 can be omitted to allow the first electrode 125 to be electrically connected to the heater 1242.

Generally, the second electrode 126 is cylindrical such that one ends of the first electrode 125 and the second electrode 126 respectively communicate with the air inlet in the atomizer base 121 to form an air intake of the inner core assembly 124.

The connection tube 123 is made of conducible material, and a lead is sandwiched between the insulation cover and the first blocking wall 1237 to electrically connect the connection tube 123 and the heater 1242.

The atomizer base 121 is also made of conducible material. One end of the atomizer base 121 is detachably connected to the connection tube 123, and the other end of the atomizer base 121 is connected to a power supply. The pin 127 is arranged on the atomizer base 121 at a position corresponding to the first electrode 125. The pin 127 is insulated from the atomizer base 121. After the connection tube 123 is connected to the atomizer base 121, the pin 127 is conducted with the first electrode 125. After the atomizer device 10 is connected to the power supply, the atomizer base 121 and the pin 127 are respectively conducted to the power supply, to supply power to the heater 1242 to vaporize the liquid solution. If the first electrode 125 is long enough, the pin 127 can also be omitted such that the first electrode 125 can be directly conducted with the power supply.

It is noteworthy that, the above-mentioned technical features can be used in any combination without restriction.

The disclosure described above of the present invention is illustrative but not restrictive scope of the present invention. Any equivalent structure, or equivalent process transformation, or directly or indirectly usage in other related technical field, all those be made in the same way are included within the protection scope of the present invention.

What is claimed is:

1. An atomizer device (10), comprising an atomizer assembly (12); the atomizer assembly (12) comprising a connection tube (123) and an inner core assembly (124) arranged in the connection tube (123); the connection tube (123) defining a liquid inlet hole (1233) allowing liquid solution to flow into the connection tube (123); the inner core assembly (124) comprising a heater (1242) for heating and atomizing the liquid solution flowing into the connection tube (123); wherein the connection tube (123) comprises a first connection member (1231) and a second connection member (1232) detachably connected with the first connection member (1231); and the first connection member (1231) and the second connection member (1232) defines a receiving space in which the inner core assembly (124) is detachably arranged; the atomizer assembly (12) further comprises a conducible atomizer base (121), and the connection tube (123) is detachably connected with the atomizer base (121); wherein the atomizer device (10) further comprises a liquid reservoir assembly (11); the atomizer assembly (12) is detachably connected with the liquid reservoir assembly (11), and the liquid reservoir assembly (11) forms a liquid reservoir chamber (A) for containing liquid solution, a liquid outlet (1113) allowing the liquid solution to flow out of the liquid reservoir chamber (A), and a blocker (115) blocking in the liquid outlet (1113); the atomizer assembly (12) is screwed to the liquid reservoir assembly (11) and is capable of driving the blocker (115) to rotate, thereby driving the blocker (115) to rotate to open the liquid outlet (1113) while being installed and driving the blocker (115) to rotate to close the liquid outlet (1113) while being removed; and the liquid outlet (1113) corresponds to the liquid inlet hole (1233) such that liquid solution can be injected into the connection tube (123) when the liquid outlet (1113) is opened.

2. The atomizer device (10) as claimed in claim 1, wherein the blocker (115) is annular-tubular-shaped and is axially positioned and installed; and the blocker (115) is formed with screw threads allowing for screw installation of the atomizer assembly (12).

3. The atomizer device (10) as claimed in claim 2, wherein an inclined surface (1154) is defined at an edge of a bottom end surface of the blocker (115), and the inclined surface (1154) is formed with knurling or grooves which are circumferentially spaced.

4. The atomizer device (10) as claimed in claim 3, wherein the atomizer base (121) comprises a threaded portion (1211) engaging with screw threads formed on the blocking portion (1153), an outer ring of the threaded portion (1211) is provided with a sealing ring (122), and a position of the sealing ring (122) corresponds to that of the inclined surface (1154).

5. The atomizer device (10) as claimed in claim 4, wherein an opening (1151) corresponding to the liquid outlet (1113) is defined in the blocker (115); before the atomizer assembly (12) is installed, the opening (1151) misaligns with the liquid outlet (1113) to close the liquid outlet (1113); and after the atomizer assembly (12) is installed, the opening (1151) aligns with the liquid outlet (1113) to communicate the liquid reservoir chamber (A) with the atomizer assembly (12).

6. The atomizer device (10) as claimed in claim 5, wherein the number of the liquid outlet (1113) and that of the opening (1151) are respectively four, and the four liquid outlets (1113) and the four openings (1151) are respectively circumferentially evenly spaced; and a size of the liquid outlet (1113) corresponds to that of the opening (1151), and a maximum radian of the liquid outlet (1113) or a maximum radian of the opening (1151) is less than 45 degrees.

7. The atomizer device (10) as claimed in claim 1, wherein the liquid reservoir assembly (11) comprises an inner tube (111) and an outer tube (112); the liquid reservoir chamber (A) is formed between the inner tube (111) and the outer tube (112); and the liquid outlet (1113) is formed in the inner tube (111), and the blocker (115) is attached to an inner wall of the inner tube (111).

8. The atomizer device (10) as claimed in claim 7, wherein a lower end of the inner tube (111) is formed with a bending portion (1111) extending laterally outwards and a sleeved portion (1113) extending axially downwards from on an outer edge of the bending portion (1111); the blocker (115) comprises a sleeve tube sleeved by an inner wall of the inner tube (111) and an annular-tube-shaped blocking portion (1153) arranged on a lower end of the sleeve tube; the blocking portion (1153) and the sleeve tube are coaxially arranged, and an outer radius of the blocking portion is greater than that of the sleeve tube; and an upper end of the blocking portion (1153) abuts the bending portion (1111), and the sleeved portion (1112) is sleeved on the blocking portion (1153).

9. The atomizer device (10) as claimed in claim 8, wherein the liquid reservoir assembly (11) further comprises a positioning ring (116); the positioning ring (116) comprises a third sleeve tube (1161) located between the sleeved portion (1211) and the blocking portion (1153); the sleeved portion (1211), the third tube, and the blocking portion (1153) are sleevedly connected in sequence from outside to inside; and an inner ring of the third sleeve tube (1161) is formed with a protrusion (1162) abutting a lower end of the blocking portion (1153).

10. The atomizer device (10) as claimed in claim 8 further comprising a restricting mechanism for restricting a rotation range of the blocker (115).

11. The atomizer device (10) as claimed in claim 10, wherein the restricting mechanism comprises an arc slot (1114) formed in the inner tube (111) and a convex stage (1162) arranged on the blocker (115) being inserted into the arc slot (1114).

12. The atomizer device (10) as claimed in claim 11, wherein the arc slot (1114) is formed in the bending portion (1111), and the convex stage (1162) is arranged on an end surface of the blocking portion (1153) corresponding to the bending portion (1111).

13. The atomizer device (10) as claimed in claim 1, wherein a first friction is generated between the blocker (115) and the liquid reservoir assembly (11), a second friction is generated between the blocker (115) and the atomizer assembly (12), and the second friction is greater than the first friction.

14. An electronic cigarette, comprising an atomizer device (10) having an atomizer assembly (12); the atomizer assembly (12) comprising a connection tube (123) and an inner core assembly (124) arranged in the connection tube (123); the connection tube (123) defining a liquid inlet hole (1233) allowing liquid solution to flow into the connection tube (123); the inner core assembly (124) comprising a heater (1242) for heating and atomizing the liquid solution flowing into the connection tube (123); wherein the connection tube (123) comprises a first connection member (1231) and a second connection member (1232) detachably connected with the first connection member (1231); and the first connection member (1231) and the second connection member (1232) defines a receiving space in which the inner core assembly (124) is detachably arranged; the atomizer assembly (12) further comprises a conducible atomizer base (121), and the connection tube (123) is detachably connected with the atomizer base (121); wherein the atomizer device (10) further comprises a liquid reservoir assembly (11); the atomizer assembly (12) is detachably connected with the liquid reservoir assembly (11), and the liquid reservoir assembly (11) forms a liquid reservoir chamber (A) for containing liquid solution, a liquid outlet (1113) allowing the liquid solution to flow out of the liquid reservoir chamber (A), and a blocker (115) blocking in the liquid outlet (1113); the atomizer assembly (12) is screwed to the liquid reservoir assembly (11) and is capable of driving the blocker (115) to rotate, thereby driving the blocker (115) to rotate to open the liquid outlet (1113) while being installed and driving the blocker (115) to rotate to close the liquid outlet (1113) while being removed; and the liquid outlet (1113) corresponds to the liquid inlet hole (1233) such that liquid solution can be injected into the connection tube (123) when the liquid outlet (1113) is opened.

15. The electronic cigarette as claimed in claim 14, wherein the first connection member (1231) comprises a first sleeve tube (1236), the second connection member (1232) comprises a second sleeve tube (1234), and one end of the first sleeve tube (1236) is connected to one end of the second sleeve tube (1234); and the inner core assembly (124) is cylindrical and axially passes through the first sleeve tube (1236) and the second sleeve tube (1234).

16. The electronic cigarette as claimed in claim 15, wherein the first connection member (1231) comprises an annular first blocking wall (1237) abutting one end of the inner core assembly (124); the second connection member (1232) comprises an annular second blocking wall (1235) abutting the other end of the inner core assembly (124); the two ends of the inner core assembly (124) are respectively in sealing engagement with the first blocking wall (1237) and the second blocking wall (1235); a central portion of the inner core assembly (124) defines an axial through hole, and the through hole communicates with a center of the first blocking wall (1237) and a center of the second blocking wall (1235) to allow smoke to flow therethrough.

17. The electronic cigarette as claimed in claim 16, wherein the inner core assembly (124) further comprises a conducible fixing tube (1243) axially passing through the connection tube (123) and a cylindrical liquid absorbing member (1241) arranged in the fixing tube (1243) for absorbing tobacco oil; the heater (1242) is arranged in the liquid absorbing member (1241) and is electrically connected to the fixing tube (1243), and the fixing tube (1243) defines a liquid absorbing hole (1244) corresponding to the liquid inlet hole (1233).

18. The electronic cigarette as claimed in claim 17, wherein a size of an inner hole of the first sleeve tube (1236) is different from that of an inner hole of the second sleeve tube (1234) to form a step (1238) at a connecting position of the first sleeve tube (1236) and the second sleeve tube (1234) on an inner wall of the connection tube (123) after the first sleeve tube (1236) and the second sleeve tube (1234) are assembled together, and a positioning stage abutting the step (1238) is arranged on an outer wall of the fixing tube (1243).

19. The electronic cigarette as claimed in claim 15, wherein an elastic annular first sealing gasket (1245) is arranged between the first connection member (1231) and the corresponding end of the inner core assembly (124), an elastic annular second sealing gasket (1247) is arranged between the second connection member (1232) of the corresponding end of the inner core assembly (124); the first sealing gasket (1245) and the second sealing gasket (1247) are respectively interchangeable between a compressed state and a rebounding state; after the first connection member and the second connection member (1232) are installed, the first sealing gasket (1245) and the second sealing gasket (1247) are compressed; after the first connection member (1231) and the second connection member (1232) are detached, the first sealing gasket (1245) and the second sealing gasket (1247) respectively rebound from the compressed state.

20. The electronic cigarette as claimed in claim 17, wherein the atomizer assembly (12) further comprises a conducible first electrode (125); the first electrode (125) comprises a cylindrical body, and the cylindrical body passes through in an inner hole of the first blocking wall and is insulated from the first blocking wall (1237); the first electrode (125) is electrically connected to the heater (1242); and the connection tube (123) is made of conducible material and is electrically connected to the fixing tube (1243).

21. The electronic cigarette as claimed in claim 20, wherein the inner core assembly (124) further comprises a conducible cylindrical second electrode (126); the second electrode (126) passes through an end side hole of the fixing tube (1243) corresponding to the first blocking wall (1237), and an insulation cover is arranged between the first and second electrodes (126) and the end side hole of the fixing tube (1243); and an outer ring of the second electrode (126) is electrically connected to the heater (1242), the first electrode (125) and the second electrode (126) axially abut each other and are in conduction with each other, and the first electrode (125) is electrically connected to the heater (1242) through the second electrode (126).

* * * * *